US005240667A

United States Patent [19]

Andrews, Jr. et al.

[11] Patent Number: 5,240,667

[45] Date of Patent: Aug. 31, 1993

[54] PROCESS OF MAKING HIGH STRENGTH, LOW SHRINKAGE POLYAMIDE YARN

[75] Inventors: Walter R. Andrews, Jr., Richmond; Marion R. De Witt, Jr., Midlothioan, both of Va.

[73] Assignee: E. I. Du Pont de Nemours and Company, Wilmington, Del.

[21] Appl. No.: 791,258

[22] Filed: Nov. 13, 1991

[51] Int. Cl.[5] ..... D01D 5/16

[52] U.S. Cl. ..... 264/210.7; 264/210.8; 264/235.6; 264/290.5; 264/290.7; 264/342 RE

[58] Field of Search ..... 264/210.7, 210.8, 290.5, 264/290.7, 342 RE, 235.6; 428/357, 364

[56] References Cited

U.S. PATENT DOCUMENTS

| | | | |
|---|---|---|---|
| 2,807,863 | 10/1957 | Schenker | 264/210.7 |
| 3,124,632 | 3/1964 | Larkin et al. | 264/290.7 |
| 3,441,642 | 4/1969 | Engelman et al. | 264/290.7 |
| 3,452,131 | 6/1969 | Geerdes et al. | 264/210.7 |
| 3,662,440 | 5/1972 | Hill et al. | 264/168 |
| 4,113,821 | 9/1978 | Russell et al. | 264/210.7 |
| 4,485,063 | 11/1984 | Good | 264/290.7 |
| 4,624,816 | 11/1986 | Kurita et al. | 264/210.7 |
| 4,859,389 | 8/1989 | Kurita et al. | 264/210.7 |
| 5,066,439 | 11/1991 | Nishikawa et al. | 264/210.7 |

FOREIGN PATENT DOCUMENTS

| | | | |
|---|---|---|---|
| 0098616 | 1/1984 | European Pat. Off. | 264/210.7 |

*Primary Examiner*—Jeffery Thurlow

[57] ABSTRACT

An improved process for making high tenacity polyamide yarn of the type including the coupled steps of spinning, drawing the yarn at least about 5.OX in stages, the final draw stage employing final stage draw rolls which are heated to above about 200° C., relaxing the yarn by advancing the yarn onto at least one tension letdown roll, and winding up the yarn. The improved process includes heating the yarn tension letdown roll to above about 200° C., rotating the tension letdown roll at a peripheral speed which is at least about 11% less than the peripheral speed of the final stage draw rolls, and contacting the yarn between the final stage draw rolls and the tension letdown roll with tension control means for increasing the tension on the yarn advancing onto the tension letdown roll.

12 Claims, 1 Drawing Sheet

PROCESS OF MAKING HIGH STRENGTH, LOW SHRINKAGE POLYAMIDE YARN

BACKGROUND OF THE INVENTION

The present invention relates to a process for making high strength, low shrinkage polyamide yarn and yarn made thereby and more particularly relates to method for making a high strength, low shrinkage polyamide yarn in a coupled, high-speed spin/draw process which is useful for high volume production of industrial polyamide yarns.

High strength polyamide yarns are useful for a wide variety of industrial applications including use as reinforcement in tires, conveyor belts, hoses, and other reinforced rubber goods, use in plastic-coated fabrics, and in ropes, cordage, webbing, and woven fabrics. For reasons including cost reduction, energy savings, fabric yield, and end use product safety, converters of polyamide yarns to such uses desire the yarn to have a combination of properties including high tenacity and low shrinkage upon heating. Particularly desirable properties are a tenacity of at least about 9.5 g/d and a shrinkage of less than about 4.0%. This combination of properties is difficult to produce, particularly in a high speed, coupled spin/draw process for high volume commercial production.

Known coupled spin/draw processes for making multifilament polyamide yarns of high tenacity draw the spun filaments in at least two stages. In some known processes, the yarn is first drawn without heating often using snubbing pins in a first drawing stage. The yarn is then heated in a second draw stage to enable drawing to greater than 5.0X draw ratio required for high tensile properties.

In processes of this type, the shrinkage will usually be quite high (over 10%) unless process steps are taken to decrease the shrinkage to a desired extent. The shrinkage can be significantly reduced by heating the yarn at high temperature at constant length and subsequently allowing it to retract/relax at elevated temperatures. In the coupled spin/draw/anneal process described in U.S. Pat. No. 3,311,691, the yarn is annealed by the hot second (and final) stage draw rolls and allowed to relax by operating the tension letdown rolls at a slower speed than the second stage rolls. The amount of retraction/relaxation of the yarn obtained in a process of this type can be described as percent (%) letdown which is defined for the purposes of this application as:

$$\% \text{ letdown} = \frac{(\text{final stage draw roll speed} - \text{tension letdown roll speed})(100)}{\text{final stage draw roll speed}}$$

There is an inverse relationship between % letdown of the spinning process and the resulting yarn shrinkage, i.e., a high % letdown results in a low shrinkage.

In the process of U.S. Pat. No. 3,311,691, it is difficult to string-up and operate a high speed coupled spin/draw process at a high % letdown. String-up and commercial continuity of operation cannot be readily accomplished at greater than approximately 8% letdown since the wraps of yarn on the tension letdown rolls are at too low tension. The insufficient tension can either cause the yarns to become entangled and form a wrap band or one of more filaments may wrap on one of the rolls. In either case, the process must be shut down. While the tension letdown rolls ultimately become heated from the heat carried by the advancing yarn (temperatures on the order of 110° C.) which enables a higher % letdown, it is generally not possible to employ a % letdown of greater than about 9%. Accordingly, using the process of U.S. Pat. No. 3,311,691, shrinkages usually cannot be decreased to below about 5.5% while maintaining tenacities above about 9.5 g/d.

SUMMARY OF THE INVENTION

The invention relates to an improved process for making a high strength polyamide yarn and the yarn made thereby. The process is of the type which includes the coupled steps of spinning the yarn, drawing the yarn at least about 5.0X in stages including at least an initial draw stage and a final draw stage in which the yarn is contacted by and advanced between rolls which are rotated at successively higher peripheral speeds, the final draw stage employing final stage draw rolls which are heated to above about 200° C., relaxing the yarn by advancing the yarn onto at least one tension letdown roll which is rotated at a lower peripheral speed than the final stage draw rolls, and winding up the yarn.

In accordance with the invention, the improved process includes heating the yarn tension letdown roll to above about 200° C., rotating the tension letdown rolls at a peripheral speed which is at least about 11% less than the peripheral speed of the final stage draw rolls, and contacting the yarn between the final stage draw rolls and the tension letdown roll with tension control means for increasing the tension on the yarn advancing onto the tension letdown roll.

In accordance with a preferred form of the invention, the tension control means increases the tension on said yarn advancing onto said tension letdown roll sufficiently to stabilize yarn tracking and prevent slippage on said tension letdown roll.

In accordance with one preferred embodiment of the present invention, the tension control means comprises at least one stationary, generally cylindrical snubbing pin, preferably cooled to below about 50° C. Most preferably, two of such pins are used with each contacting the yarn on a portion of the pin surface to provide a total wrap angle of between about 80° and 180°.

The process of the invention is advantageously used to produce polyamide yarns with a tenacity of greater than about 9.5 g/d and a yarn dry heat shrinkage of less than about 3.5%. Preferably, the process is operated so that the yarn is wound up at a speed of at least about 2000 ypm, most preferably at least about 2400 ypm.

The combination of a hot tension letdown roll or set of rolls together with snub pins enables: a) ease of positional string-up, b) minimum string-up waste, and c) good spinning continuity at very high % letdown, i.e., up to 15% letdown or more. The high tension letdown roll temperature and additional increment of % letdown result in further on-machine yarn relaxation and enables the high speed production of yarns with the desirable combination of physical properties described herein.

In accordance with the invention, a multifilament polyamide yarn is provided having a formic acid relative viscosity (RV) of at least about 60, a tenacity of at least about 9.5 g/d, a yarn dry heat shrinkage at 160° C. of less than 3.5%, and a tire cord dry heat shrinkage at 160° C. of less than about 2.5%. The yarns of the invention are extremely thermally stable and are readily converted to tire cords with substantially decreased shrinkage and with only a modest loss in tenacity.

DETAILED DESCRIPTION

Figure 1:
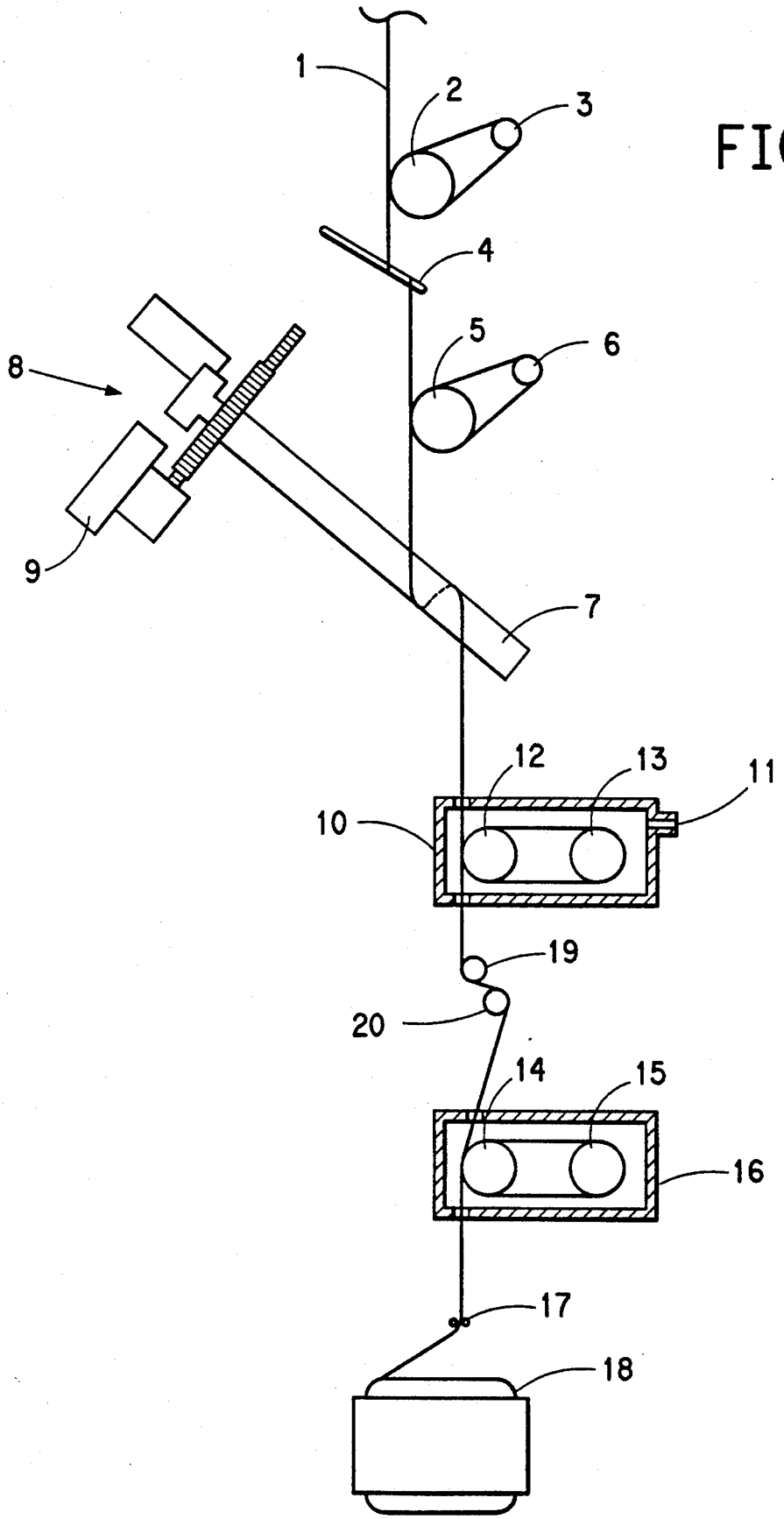
FIG. 1 is a schematic view of a preferred process in accordance with the present invention.

Polyamide as used in this application refers to any of the various generally linear, aliphatic polycarbonamide homopolymers and copolymers which are typically melt-spinnable and, when drawn, yield fibers having properties suitable for industrial applications. For example, poly(hexamethylene adipamide) (6,6 nylon) and poly(ε-caproamide) (6 nylon), poly(tetramethylene adipamide) (4,6 nylon) are typically-used polyamides for industrial fibers. The invention is also applicable to copolymers and mixtures of polyamides although such copolyamides and mixtures are generally not preferred since shrinkage and fatigue strength loss are typically increased over homopolymers. Because of a balance of properties including dimensional stability which is imparted to the resulting fiber and reasonable melt-processing temperatures, homopolymer poly(hexamethylene adipamide) (6,6 nylon) is the most preferred polyamide for the practice of the present invention. As is well known, 6,6 nylon and other polyamides can be manufactured in an autoclave or continuous polymerizer.

Depending on the particular end-use, the polyamide may contain other materials such as thermal protective agents, catalysts, antioxidants, pigments/delustrants, and other additives. Examples of thermal protective agents are copper salts, usually in combination with alkali metal halides. Typical antioxidants for polyamides are phosphorous compounds, such as phenylphosphinic acid and its salts, or hindered phenols.

Polyamides for fiber produced in accordance with the process of the present invention generally have an RV of at least about 50, preferably at least about 60. In order to maximize yarn drawability and optimize yarn physical properties, it is most preferable to employ polyamide polymer having an RV above about 90 with a high level of linear polymer molecules, i.e., with a low level of branching.

In the preferred form of the process of this invention, such high quality, high RV polymer is produced through a continuous melt-polymerization process using a phosphorous compound catalyst together with a base. Particularly advantageous phosphorous compound catalysts are the catalysts of the formula:

$$X—(CH_2)_nPO_3R_2$$

wherein X is 2-pyridyl, 4-morpholino, 1-pyrrolidino, 1-piperidino or $R'_2$-N- wherein R', being the same or different, is an alkyl group having between 1 and 12 carbon atoms; n is an integer from 2 to 5; R, being the same or different, is H or an alkyl group having between 1 and 12 carbon atoms since catalytic activity is retained well in the presence of base. An especially preferred catalyst is 2-(2'-pyridyl)ethyl phosphonic acid and its alkyl esters and preferred bases are potassium hydroxide or potassium bicarbonate. Preferably, the catalyst is present in the polyamide in an amount between about 1 and about 15 moles per $10^6$ g of polymer and the base is present in an amount between about 1 and about 40 equivalents per $10^6$ g of polymer. It is also advantageous for the ratio of equivalents of base to moles of total phosphorous acid compounds present in the mixture to be at least about 0.5, preferably, at least about 1.0, most preferably at least about 2.0. "Total phosphorous acid compounds" is intended to refer to all phosphorus-containing compounds present in the polymer which contribute to the acidity of the polymer in the molten state. Such compounds include, for example, catalysts in accordance with Formula I above, being either free acid or esters, together with other phosphorus-containing compounds which serve other functions such as antioxidants and which contribute to polymer acidity.

As will be described in more detail hereinafter, the process of the invention is an improvement of a process where the polymer is spun and drawn using a high speed process such as the coupled spin/draw/anneal process described in U.S. Pat. No. 3,311,691. U.S. Pat. No. 3,311,691 is hereby incorporated by reference. The process of the invention thus is of the type which includes the coupled steps of spinning the yarn, drawing the yarn at least about 5.0X in stages including at least an initial draw stage and a final draw stage in which the yarn is contacted by and advanced between rolls which are rotated at successively higher peripheral speeds, the final draw stage employing final stage draw rolls which are heated to above about 200° C., relaxing the yarn by advancing the yarn onto tension letdown rolls which are rotated at a lower peripheral speed than the final stage draw rolls, and winding up the yarn.

For tire cord and most other industrial yarn applications, the filaments have a denier per filament (dpf) between about 3 dpf and about 9 dpf with 6 dpf (nominal) being typical. The yarns are generally over about 200 denier and are typically spun as yarn bundles with sizes of 210, 315, 420, 630, 840, 1260, 1680, and 1890 deniers (nominal).

In accordance with the invention, tension letdown rolls are heated to above about 200° C. The process described in U.S. Pat. No. 3,311,691 uses unheated tension letdown rolls and, during stringup in a process in accordance with the teachings of that patent at the high % letdown values, it is necessary to hold the yarn in the stringup gun before the windup for 10 to 15 minutes while waiting for the hot yarn from the hot chest to heat the tension letdown rolls to their ~110° C. operating temperature. It is then possible to string from the tension letdown rolls to the windup and maintain good spinning continuity at up to 8–9% letdown At string-up, if the tension letdown rolls are at a temperature less than 90° C., the running yarn coming from the hot chest cools, elongates, and forms very loose wraps on the tension letdown rolls. These wraps are so loose that frequent breakouts occur resulting in poor spinning continuity.

Increasing the temperature of the tension letdown rolls results in greater on-machine yarn shrinkage, a higher yarn tension on these rolls, and therefore, stable yarn wraps during positional stringup and during normal operation. With heated tension letdown rolls at ~200° C. surface temperature, maximum % letdown is approximately 12% before yarn wrap instability occurs. However, even with heated tension letdown rolls, high tenacity yarns with a dry heat shrinkage of significantly less than 4% at 160° C. cannot be made.

For the purpose of further reducing shrinkage in a process in accordance with the invention, the yarn is contacted between the heated final stage draw rolls and the heated tension letdown rolls with tension control means for increasing the tension on the yarn advancing onto the tension letdown rolls. The tension control means preferably operates to increase the tension on the yarn advancing onto said tension letdown rolls sufficiently to stabilize yarn tracking and prevent slippage on the tension letdown rolls. While any of a variety of tension control devices may be used such as driven rolls, braked rolls, etc., a preferred tension control means is at least one stationary, generally cylindrical snubbing pin, advantageously, a pin having a diameter of between about 0.5 and 2.0 inches. The pin can be made of any of a variety of materials but should have a low friction, wear-resistant surface. Preferably, to minimize potential finish oil varnishing on the pin and thereby enable long term spinning continuity with good yarn quality and yield, the snubbing pin is cooled to below about 50° C. such as by the internal circulation of a cooling fluid. In the preferred embodiment depicted in more detail hereinafter, two stationary, generally cylindrical snubbing pins are used, each of the pins contacting the yarn on a portion of its surface so that the total wrap angle is between about 80° and 180°. Guide pins may be used in conjunction with the snub pins to precisely position the yarn bundles feeding onto the tension letdown rolls.

Surprisingly, the tension control means between the final stage draw rolls and tension letdown rolls are effective in further stabilizing the yarn wraps on the tension letdown rolls without causing undue yarn breaks. Also, the tension drop across the tension control means reduces the yarn tension leaving the hot second stage rolls thereby allowing additional on-machine yarn relaxation to occur in this high temperature zone. Thus, it is the combination of the tension letdown rolls heated to at least 200° C. and the tension control means for increasing the tension on the yarn advancing onto the tension letdown rolls that makes it possible to achieve at least about 11% letdown, and as high as 15% or more, without the problems which can result using known processes.

As in known processes, the speed difference between the tension letdown rolls and the windup is controlled to maintain ~0.15–0.25 g/d windup tension as required to obtain good package formation.

The process of this invention is amenable to higher speed processing of polyamide yarns. Hence, winding speeds of over 2000 ypm can be readily attained and are preferred and speeds of 2400 ypm and over are quite feasible and are more preferred.

Referring now to the drawings, FIG. 1 illustrates a two stage drawing process in accordance with the invention for drawing the yarn at least about 5.0 x. A polyamide yarn 1 containing a lubricating finish (finish application not shown) is advanced in the first draw stage by a driven roll 2 and associated separator roll 3 which provide feed roll means for the yarn 1. Driven roll 5 and associated separator roll 6 form draw roll means for the first drawing stage as well as the feed roll for the second stage. A snubbing pin 4, conveniently made of an abrasion resistant material such as aluminum oxide, sapphire, chromium plate or the like, is provided as a frictional element in the first draw zone to localize the draw point. The amount of draw imparted in the first draw stage can be, for example, between about 2.2 to about 5.0X.

The yarn 1 enters the second draw stage from the rolls 5 and 6 and spirally advances in frictional contact with a draw assist element 7 on which most of the draw of the second draw stage occurs. Preferably, the yarn travels on the draw-assist element in an extended spiral path with between about 1½ and 3½ wraps about a major portion of the element (e.g., over a length of about ⅔ meter). In the preferred draw assist element depicted, element 7 is cylindrical and has a wear-resistant cylindrical surface such as that which can be provided by chromium plated steel. The draw assist element 7 is also preferably tubular so that heating means can be provided in its interior. Any of a variety of heating means can be employed such as circulating a heat transfer medium in the tube's interior or by a core heating element spaced-apart from the tube which is provided with an electric resistance heating element. A draw assist element of the latter type is disclosed in U.S. Pat. No. 4,880,961.

The draw assist element 7 includes a mounting means 8 which provides rotation using motor 9 at a low rate of speed so that the spirally advancing yarn will not contact the same area of the element and thus wear will occur uniformly over the element's surface.

From the draw assist element 7 the yarn directly advances to driven rolls 12 and 13 which serve as the second stage draw rolls. The speed of rotation of these rolls is such that the draw imparted to the yarn is typically at least about 1.1X. In addition, the rolls 12 and 13 are heated and are used to maintain at least one wrap of the yarn on the rolls at substantially constant length in a heated condition. Roll surface temperature is generally at least about 200° C. At high yarn speeds, a suitable heating time at constant length is achieved by having the yarn advance about the rolls in a plurality of wraps. Although other heating means may be used, a preferred heating system for the rolls 12 and 13 is to employ an annealing chest 10 which is an insulated enclosure which is supplied with hot air through duct 11.

After the yarn leaves the annealing chest, rolls 14 and 15 heated to at least about 200° C. serve as a tension letdown system and have at least an 11% lower peripheral speed than rolls 12 and 13 to achieve an 11% or greater letdown. Rolls 14 and 15 are suitably provided by electric induction heated rolls preferably enclosed in an insulated chest 16 to retain heat. Between the second stage draw rolls and tension letdown rolls, snub pins 19 and 20 act to increase the tension on the yarn advancing onto the tension letdown rolls. In the preferred process depicted, snub pins 19 and 20 are cylindrical with a diameter of 1.25 inches and have a wear-resistant cylindrical surface provided by aluminum oxide coated steel. The depicted pins are also tubular so that cooling means can be provided in their interior to cool the pins to 50° C. or below such as by circulating a cooling fluid.

From the heated tension letdown rolls 14 and 15, the yarn is wound up with a yarn guide 17 being associated with a conventional wind-up 18. A conventional yarn traversing mechanism (not shown) is also employed to form suitable yarn packages.

In the most preferred process in accordance with the invention, the process employs a continuous polymerizer which is coupled with above-described spinning and drawing steps.

The process can be used to provide multifilament yarns in accordance with the invention which have a formic acid RV of at least about 60, a tenacity of at least about 9.5 g/d, a dry heat shrinkage of less than about 3.5% and a tire cord shrinkage of less than about 2.5%.

Preferably, the polymer of the yarn of the invention is poly(hexamethylene adipamide). It is also preferably for the polymer viscosity, measured in formic acid as relative viscosity (RV), to be at least about 90. It is preferable for the Mallory CT fatigue in kilocycles to failure to be at least 78+(0.92)(Yarn Denier), wherein Mallory CT fatigue is measured in a Mallory tube in which the number of cord ends equals, when rounded to the nearest whole number, 85.9−(0.054)(yarn denier)+(0.000013)(yarn denier)$^2$.

The value of an industrial yarn is directly proportional to its tenacity and inversely proportional to its shrinkage. In addition, when intended for use as tire cords, it is desirable for the properties of the yarn to be sufficiently stable that they are retained when the yarn undergoes conversion processes into tire cords. This high tenacity yarn, greater than about 9.5 g/d, with its very low dry heat shrinkage less than about 3.5% at 160° C., preferably less than about 3.0% at 160° C., is especially valuable as an industrial yarn. This value is reflected in the ratio of yarn tenacity/yarn dry heat shrinkage ($T_Y/S_Y$) where, for the yarn of this invention, the ratio is at least about 3.0 (g/d)/% and, preferably, is at least 3.5 about (g/d)/%. Moreover, the shrinkage, when measured as tire cord dry heat shrinkage, is less than about 2.5% at 160° C., preferably less than about 2.0% at 160° C., which is substantially less than the very low shrinkage in the yarn. The low tire cord shrinkage is achieved with only a modest loss in tenacity during conversion. This value is reflected in the ratio of cord tenacity/cord dry heat shrinkage ($T_C/S_C$) where, for the yarn of this invention, the ratio is greater than about 4.0 (g/d)/% and, preferably, is greater than about 4.5 (g/d)/%.

Another aspect of the product of this invention is its very high toughness value as calculated from the product of yarn tenacity and yarn break elongation. Preferably, the yarns of this invention have a toughness value of at least 215 (g/d).%. It is also preferable for the yarns of the invention to have an elongation of at least about 21%.

TEST METHODS

Conditioning

Packaged yarns are conditioned before testing for at least 2 hours in a 55%±2% relative humidity, 74° F.±2° F. (23° C.±1° C.) atmosphere and measured under similar conditions unless otherwise indicated.

Relative Viscosity

Relative viscosity refers to the ratio of solution and solvent viscosities measured in a capillary viscometer at 25° C. The solvent is formic acid containing 10% by weight of water. The solution is 8.4% by weight polyamide polymer dissolved in the solvent.

Denier

Denier or linear density is the weight in grams of 9000 meters of yarn. Denier is measured by forwarding a known length of yarn, usually 45 meters, from a multifilament yarn package to a denier reel and weighing on a balance to an accuracy of 0.001 g. The denier is then calculated from the measured weight of the 45 meter length.

Tensile Properties

Tensile properties (Tenacity, Elongation at break and Modulus) are measured as described by Li in U.S. Pat. No. 4,521,484 at col. 2, line 61 to col 3, line 6, the disclosure of which is hereby incorporated by reference.

Initial modulus is determined from the slope of a line drawn tangential to the "initial" straightline portion of the stress strain curve. The "initial" straightline portion is defined as the straightline portion starting at 0.5% of full scale load. For example, full scale load is 50.0 pounds for 600–1400 denier yarns; therefore the "initial" straightline portion of the stress-strain curve would start at 0.25 lbs. Full scale load is 100 pounds for 1800–2000 denier yarns and the initial straightline portion of the curve would start at 0.50 lbs.

Toughness

Toughness is calculated as the product of the measured tenacity (g/d) and measured elongation at break (%).

Yarn Dry Heat Shrinkage

Dry Heat Shrinkage is measured on a Testrite shrinkage instrument manufactured by Testrite Ltd. Halifax, England. A ~24" (~61 cm) length of multifilament yarn is inserted into the Testrite and the shrinkage recorded after 2 minutes at 160° C. under a 0.05 g/d load. Initial and final lengths are determined under the 0.05 g/d load. Final length is measured while the yarn is at 160° C. To insure accuracy, yarn temperature is calibrated by attaching a thermocouple to the yarn.

Tire Cord Dry Heat Shrinkage

Cords are prepared by the Dip/Stretch Cord Preparation method described below and dry heat shrinkage is measured by the yarn dry heat shrinkage method above.

Mallory CT (Compression-Tension) Fatigue

Yarns are tested for fatigue using the well-known Mallory CT fatigue test (U.S. Pat. No. 2,412,524). In this test, adhesive treated, 2-ply, 10×10 twisted cords are prepared using treatment conditions of the Dip/-Stretch Cord Preparation method described below. The cords are cured in a rubber tube such that the axis of the cords is parallel to the longitudinal axis of the tube and with the number of cord ends in the Mallory tube being defined by the equation:

$$\text{Cord Ends} = 85.9 - (0.054)(\text{yarn denier}) + (0.000013)(\text{yarn denier})^2, \text{ when rounded to the nearest whole number}$$

The tube is clamped into two spindles and bent in a 90 degree angle. The tube is pressurized with 50 psig air throughout the test. The spindles are rotated at 850 rpm. With each spindle rotation, the test cords are subjected to alternating tension and compression. When the tube ruptured and lost air pressure, the test ended and the number of spindle cycles is recorded. Typical Cord and Tube constructions are as follows:

| Cord Construction | | | |
|---|---|---|---|
| Denier | # Yarn Ends Per Cord | Twist | # Cord Ends Per Tube |
| 840 | 2 | 10 × 10 | 50 |
| 1260 | 2 | 10 × 10 | 38 |
| 1890 | 2 | 10 × 10 | 30 |

Dip/Stretch Cord Preparation

Dip/stretch cords are prepared as follows:

Yarn is converted into a conventional 2-ply 1260/1/2 tire cord (singles twist=10 'Z' tpi; cable twist=10 'S' tpi) and processed on a multi-end, 3-oven hot stretching unit using the following process parameters in ovens 1/2/3: temperature=138° C./room temperature/238° C.; exposure time=108/54/54 seconds; applied stretch=2.4/2.4/0.0%. Cords are passed through a resorcinol-formaldehyde-latex (D5A) dip (20% dip solids) before entering the first oven. Dip pickup is about 5%.

EXAMPLES

The invention is illustrated in the following examples which are not intended to be limiting. Parts and percentages are by weight unless otherwise indicated.

EXAMPLES 1–4 and Controls A–E

Using 70 and 100 RV polyhexamethylene adipamide prepared in a continuous polymerizer, 840 (nominal) drawn denier, 140 filament yarns are prepared in a coupled polymerization/spin/draw process using drawing equipment as illustrated in FIG. 1. Table 1 lists conditions used and which also describes the resulting yarn and cord properties.

Controls A–D illustrate the process of U.S. Pat. No. 3,311,691. Control E illustrates the process of U.S. Pat. No. 3,311,691 except that the tension letdown rolls are heated to 200° C. and the % letdown is 12%.

Examples 1–4 illustrate the invention. Through the use of heated tension letdown rolls and two cooled snub pins at 28° C. and with a total wrap angle of 120° as a tension control means, it is possible to maintain yarn wrap stability on the hot tension letdown rolls while achieving the high % letdown reported at commercial wind-up speeds. This greater on-machine yarn shrinkage enabled the achievement of yarns with unusually low values of dry heat shrinkage while maintaining high yarn strength. In addition, the yarns are thermally stable and exhibit high cord tenacities with extremely low cord shrinkages.

TABLE 1

| ITEM | CONTROLS A | B | C | D | E | EXAMPLES 1 | 2 | 3 | 4 |
|---|---|---|---|---|---|---|---|---|---|
| PROCESS | | | | | | | | | |
| Polymer RV | 70 | 100 | 100 | 100 | 100 | 100 | 100 | 70 | 100 |
| Second Stage Draw Roll Temp. (°C.) | 220 | 220 | 20 | 240 | 220 | 220 | 220 | 220 | 220 |
| Second Stage Draw Roll Speed (YPM) | 2800 | 2800 | 2800 | 2800 | 2800 | 2800 | 2800 | 2800 | 2800 |
| Total Draw Ratio | 5.2 | 5.3 | 5.3 | 5.3 | 5.3 | 5.3 | 5.3 | 5.2 | 5.3 |
| Snub Pins Before Tension Letdown Rolls | No | No | No | No | No | Yes | Yes | Yes | Yes |
| Temp. of Snub Pins (°C.) | — | — | — | — | — | 28 | 28 | 28 | 28 |
| Tension Letdown (TDL) Roll Temp. (°C.) | 110 | 110 | 110 | 120 | 200 | 200 | 200 | 230 | 215 |
| % Letdown | 5.13 | 5.4 | 8.0 | 8.0 | 12 | 12 | 15 | 13 | 13 |
| Windup Yarn Speed (ypm) | 2667 | 2664 | 2598 | 2607 | 2506 | 2524 | 2464 | 2500 | 2492 |
| Windup Speed - TLD Speed (ypm) | +11 | +15 | +22 | +31 | +42 | +60 | +84 | +64 | +56 |
| %* | +0.4 | +0.5 | +0.9 | +1.2 | +1.7 | +2.4 | +3.4 | +2.6 | +2.3 |
| Windup Speed/2nd Stage DR Speed | 0.95 | 0.95 | 0.92 | 0.93 | 0.90 | 0.90 | 0.88 | 0.89 | 0.89 |
| YARN | | | | | | | | | |
| Yarn RV | 67 | 94 | 94 | 94 | 94 | 94 | 94 | 67 | 94 |
| Yarn Tenacity, g/d | 9.8 | 10.3 | 10.2 | 10.2 | 10.1 | 10.0 | 9.7 | 9.6 | 9.9 |
| Yarn % Break Elongation | 18 | 18 | 19 | 20 | 21 | 22 | 24 | 23 | 22 |
| Yarn % Shrinkage, 160° C. | 5.5 | 6.2 | 5.5 | 5.3 | 4.1 | 2.8 | 2.0 | 2.3 | 2.5 |
| Tenacity/% Shrinkage, (g/d)/% | 1.8 | 1.7 | 1.9 | 1.9 | 2.5 | 3.6 | 4.9 | 4.2 | 4.0 |
| Yarn Toughness, (g/d)/% | 176 | 185 | 194 | 204 | 212 | 220 | 235 | 221 | 220 |
| CORD** | | | | | | | | | |
| Mallory CT Fatigue, Kilocycles to Failure | 400 | 1000 | 1000 | 1000 | 1000 | 1000 | 1000 | 400 | 1000 |
| Cord Tenacity, g/d | 8.2 | 8.7 | 8.6 | 8.5 | 8.5 | 8.4 | 8.2 | 8.1 | 8.3 |
| Cord % Shrinkage, 160° C. | 4.5 | 5.2 | 4.5 | 4.3 | 3.1 | 1.8 | 1.0 | 1.3 | 1.5 |
| Cord Tenacity/% Shrinkage, (g/d)/% | 1.8 | 1.7 | 1.9 | 2.0 | 2.7 | 4.7 | 8.2 | 6.2 | 5.5 |

$$*\% = \frac{(\text{Windup Speed} - \text{TLD Speed})(100)}{\text{Windup Speed}}$$

**Dip/Stretch Tire Cord

We claim:

1. In a process for making a high strength polyamide yarn comprising the coupled steps of spinning the yarn, drawing the yarn at least about 5.0X in stages including at least an initial draw stage and a final draw stage in which the yarn is contacted by and advanced between rolls which are rotated at successively higher peripheral speeds, said final draw stage employing final stage draw rolls which are heated to above about 200° C., relaxing the yarn by advancing the yarn on at least one tension letdown roll which is rotated at a lower peripheral speed than said final stage draw rolls, and winding up the yarn at a speed greater than about 2000 ypm, the improvement comprising:

heating said yarn tension letdown roll to above about 200° C.;

rotating said tension letdown roll at a peripheral speed which is at least about 11% less than the peripheral speed of said final stage draw rolls; and contacting the yarn between said final stage draw rolls and said tension letdown roll with a tension control device selected from the group consisting of driven rolls, braked rolls, and at least one stationary, generally cylindrical snubbing pin.

2. The process of claim 1 wherein said tension control means increases the tension on said yarn advancing onto said tension letdown roll sufficiently to stabilize yarn tracking and prevent slippage on said tension letdown roll.

3. The process of claim 2 wherein said tension control means comprises at least one stationary, generally cylindrical snubbing pin.

4. The process of claim 3 wherein said snubbing pin is cooled to below about 50° C.

5. The process of claim 3 wherein said snubbing pin has a diameter of between about 0.5 and 2.0 inches.

6. The process of claim 1 wherein said tension control means comprises two stationary, generally cylindrical snubbing pins, each of said pins contacting the yarn on a portion of the pin surface with a total wrap angle between about 80° and 180°.

7. The process of claim 1 wherein the yarn produced by the process has a tenacity of greater than about 9.5 g/d and a dry heat shrinkage of less than about 3.5%.

8. The process of claim 1 wherein said polyamide yarn has an RV of at least about 60.

9. The process of claim 1 wherein said yarn has an RV of at least about 90.

10. The process of claim 1 wherein said yarn is poly(-hexamethylene adipamide) yarn.

11. The process of claim 1 wherein said winding up of the yarn is performed at a speed of greater than about 2400 ypm.

12. The process of claim 1 when said tension letdown roll is heated to at least about 220° C.

* * * * *